US008227678B2

(12) United States Patent
Frirsz

(10) Patent No.: US 8,227,678 B2
(45) Date of Patent: Jul. 24, 2012

(54) TAILPIECE FOR A MUSICAL INSTRUMENT

(76) Inventor: Nicholas Frirsz, Greenfield Ctr., NY (US)

( * ) Notice: Subject to any disclaimer, the term of this patent is extended or adjusted under 35 U.S.C. 154(b) by 399 days.

(21) Appl. No.: 12/405,338

(22) Filed: Mar. 17, 2009

(65) Prior Publication Data

US 2010/0236374 A1 Sep. 23, 2010

(51) Int. Cl.
*G10D 13/02* (2006.01)

(52) U.S. Cl. ..... 84/411 R

(58) Field of Classification Search ..... 84/267, 84/299–302

See application file for complete search history.

(56) References Cited

U.S. PATENT DOCUMENTS 4,171,660 A * 10/1979 Kingsbury ..... 84/297 R
2005/0217455 A1* 10/2005 Ricci ..... 84/302

OTHER PUBLICATIONS

A Tail of Many Parts, Owenl, The Strad, Aug. 2004; pp. 1-4.*

* cited by examiner

*Primary Examiner* — Kimberly Lockett
(74) *Attorney, Agent, or Firm* — Ronald A. D'Alessandro; Keohane & D'Alessandro PLLC

(57) ABSTRACT

In general, the present invention provides a tailpiece for a musical instrument. Among other things, the tailpiece includes a treble side, a bass side, and a surface topography (i.e., along its bottom surface) causes the tailpiece to twist/rock when the bass side is brought under tension. Among other features, the topography includes a protrusion positioned proximate the treble side, and that comes in contact with the actual musical instrument. The twisting or rocking action causes a lower set of strings attached to the tailpiece to be lengthened, thus, creating difference musical sounds and/or tones.

19 Claims, 3 Drawing Sheets

TAILPIECE FOR A MUSICAL INSTRUMENT

FIELD OF THE INVENTION

The present invention generally relates to a tailpiece of a musical instrument. Specifically, the present invention relates to a tailpiece having a topography that allows it to twist/rock when (e.g., a bass side thereof) is brought under tension.

BACKGROUND OF THE INVENTION

Stringed instruments are well known throughout the musical world. As is generally know, a stringed instrument will typically include (among other pars), a body, a neck, and a set of strings. In instruments such as a violin or a viola, a tailpiece can also be included. Typically, the tailpiece is attached to the body and receives the strings, thus, holding the strings in a linear and tightened position. Current designs call for the tailpiece to remain stationary with no movement for allegedly optimal performance.

SUMMARY OF THE INVENTION

In general, the present invention provides a tailpiece for a musical instrument. Among other things, the tailpiece includes a treble side, a bass side, and a surface topography (i.e., along its bottom surface) causes the tailpiece to twist/rock when the bass side is brought under tension. Among other features, the topography includes a protrusion positioned proximate the treble side, and that comes in contact with the actual musical instrument. The twisting or rocking action causes a lower set of strings attached to the tailpiece to be lengthened, thus, creating difference musical sounds and/or tones.

A first aspect of the present invention provides a tailpiece for a musical instrument, comprising: a treble side; a bass side opposite the treble side; and a topographical surface that causes the tailpiece to twist when the bass side is brought under tension.

A second aspect of the present invention provides a tailpiece for a musical instrument, comprising: a treble side; a bass side opposite the treble side; and a 3-dimensional topography along an underside of the tailpiece, the 3-dimensional topography causing the tailpiece to twist when the bass side is brought under tension.

A third aspect of the present invention provides a tailpiece for a musical instrument, comprising: a treble side; a bass side opposite the treble side; a 3-dimensional topography along an underside of the tailpiece, the 3-dimensional topography causing the tailpiece to twist when the bass side is brought under tension; and a plurality of string holes for holding a plurality of strings, the twist lengthening a lower set of the plurality of strings.

BRIEF DESCRIPTION OF THE DRAWINGS

These and other features of this invention will be more readily understood from the following detailed description of the various aspects of the invention taken in conjunction with the accompanying drawings in which.

Figure 1A:
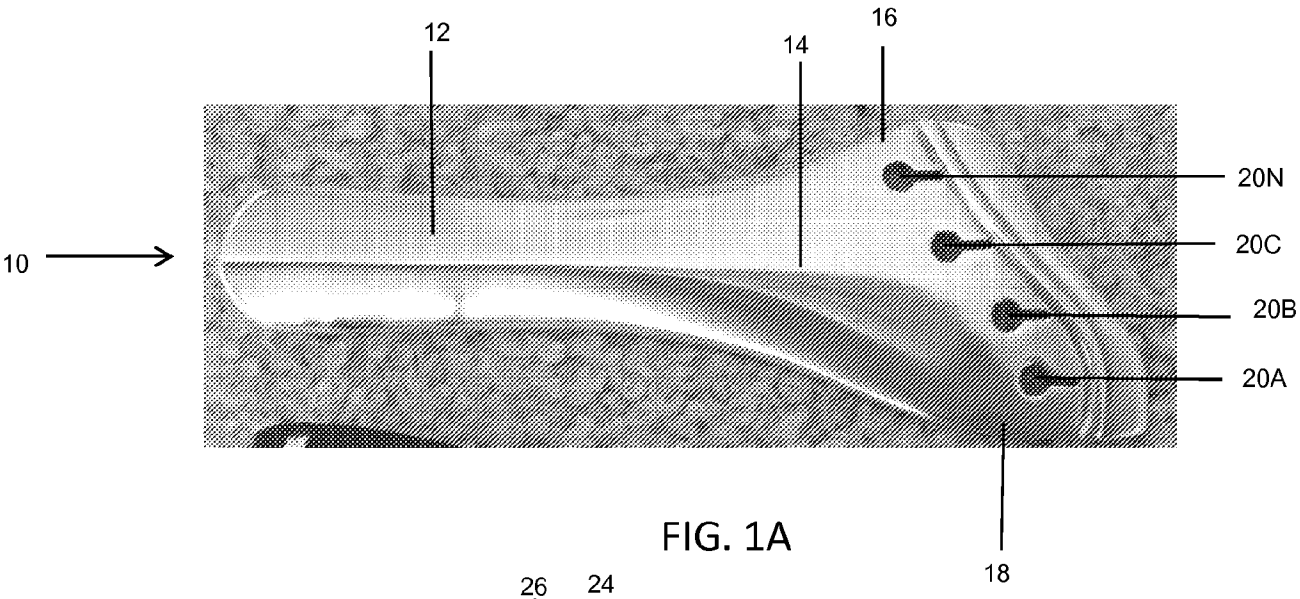
FIG. 1A depicts a top surface of a tailpiece according to one embodiment of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DESCRIPTION OF THE INVENTION

As indicated above, the present invention provides a tailpiece for a musical instrument. Among other things, the tailpiece includes a treble side, a bass side, and a surface topography (i.e., along its bottom surface) causes the tailpiece to twist/rock when the bass side is brought under tension. Among other features, the topography includes a protrusion positioned proximate the treble side, and that comes in contact with the actual musical instrument. The twisting or rocking action causes a lower set of strings attached to the tailpiece to be lengthened, thus, creating difference musical sounds and/or tones.

Figure 1B:
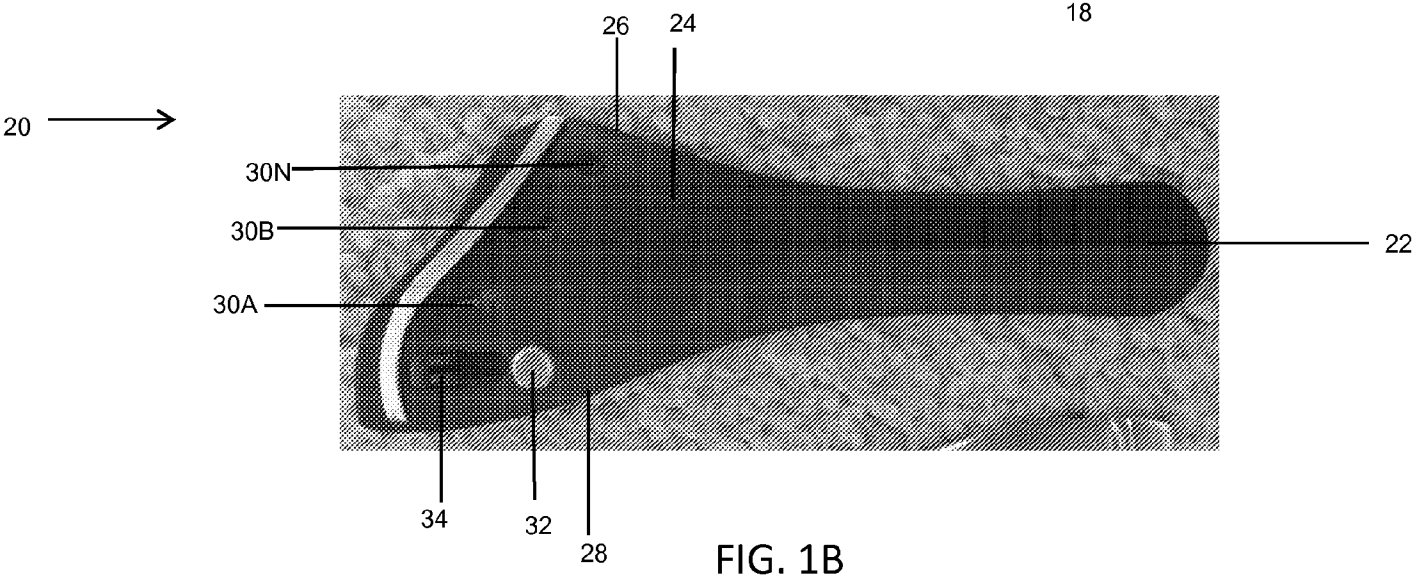
FIG. 1B depicts a top surface of a tailpiece according to another embodiment of the present invention.

Referring now to FIG. 1A, a top surface of a tailpiece 10 according to the present invention is shown. As depicted, tailpiece 10 includes a tail end 12, a head, 14, a bass side 16, a treble side 18, and a plurality of string holes 20A-N for holding a plurality of strings (shown in FIG. 3). FIG. 1B shows a top surface of another tailpiece according to the present invention. Similarly, tailpiece 20 includes a tail end 22, a head, 24, a bass side 26, a treble side 28, and a plurality of string holes 30A-N for holding a plurality of strings. Tailpiece also includes tuning screw 32 and tuner 34.

Figure 2A:
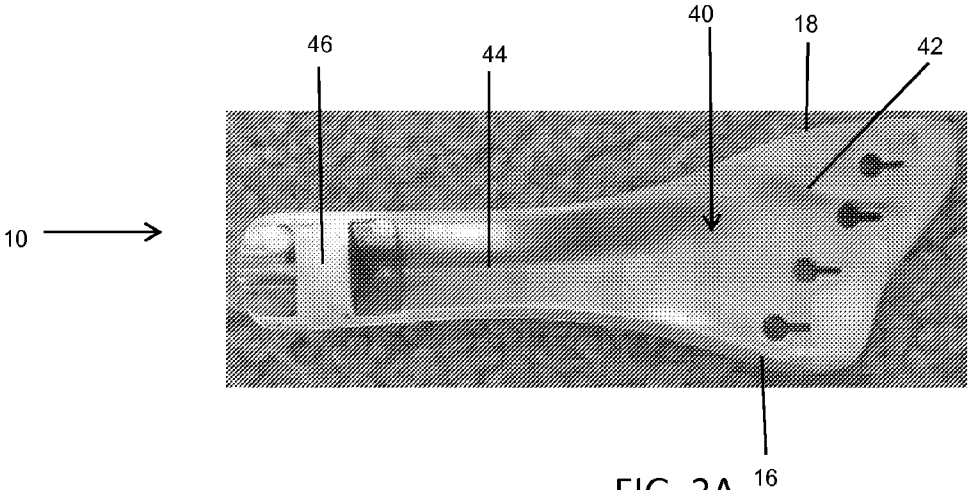
FIG. 2A depicts a bottom surface of a tailpiece according to one embodiment of the present invention.
Figure 2B:
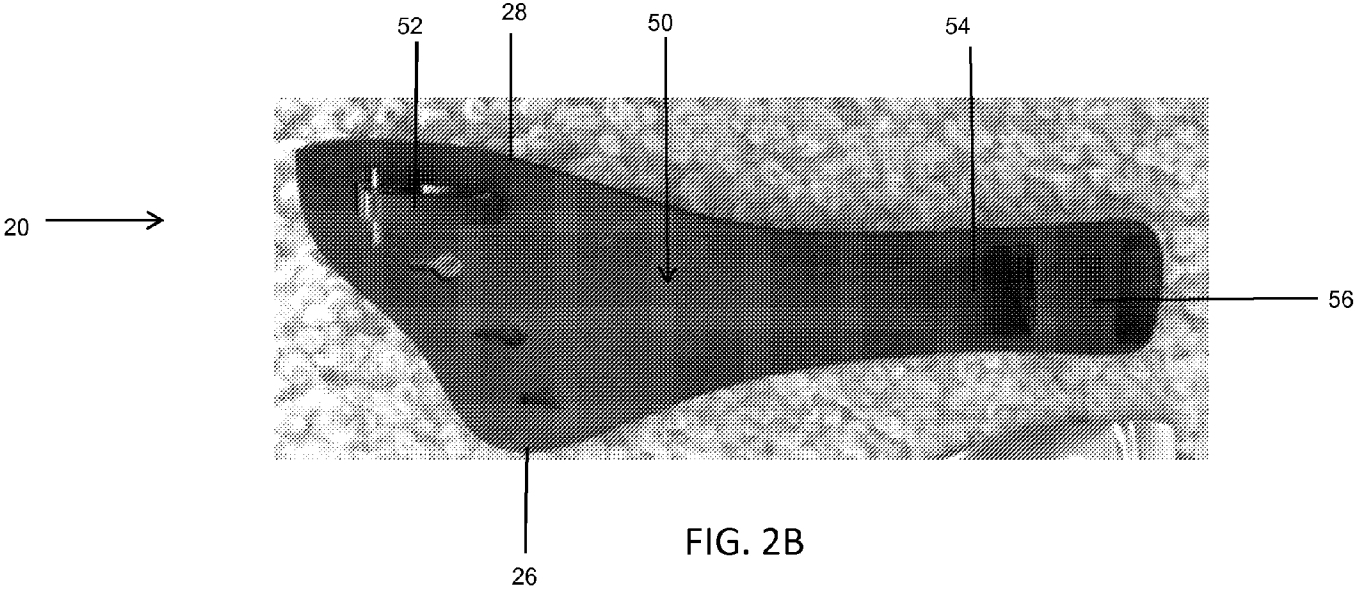
FIG. 2B depicts a bottom surface of a tailpiece according to another embodiment of the present invention.

Under the present invention, the bottom surfaces of tailpieces 10 and 20 are fashioned to have a topography that allows the tailpieces 10 and 29 to twist/rock when the base sides 16 and 26 are brought under tension. FIGS. 2A-B show the respective bottom surfaces/undersides of tailpieces 10 and 20. As shown in FIG. 2A, tailpiece 10 includes a topography 40 that includes a protrusion 42 near treble end 16. Protrusion 42 comes in contact with the musical instrument when tailpiece 10 is attached thereto. This is so that when bass end 18 is brought under tension, tailpiece 10 will twist/rock/teeter about protrusion 42. As further shown tailpiece 10 includes a channel 44 and a bracket 46 for attaching tailpiece 10 to a musical instrument.

As shown in FIG. 2B, tailpiece 20 includes a topography 50 that includes a protrusion 52 near treble end 26. Similar to protrusion 42 of tailpiece 10, protrusion 52 comes in contact with the musical instrument when tailpiece 20 is attached thereto. This is so that when bass end 18 is brought under tension, tailpiece 20 will twist/rock/teeter about protrusion 42. As further shown, tailpiece 20 includes a channel 54 and a bracket 56 for attaching tailpiece 20 to a musical instrument.

Figure 3:
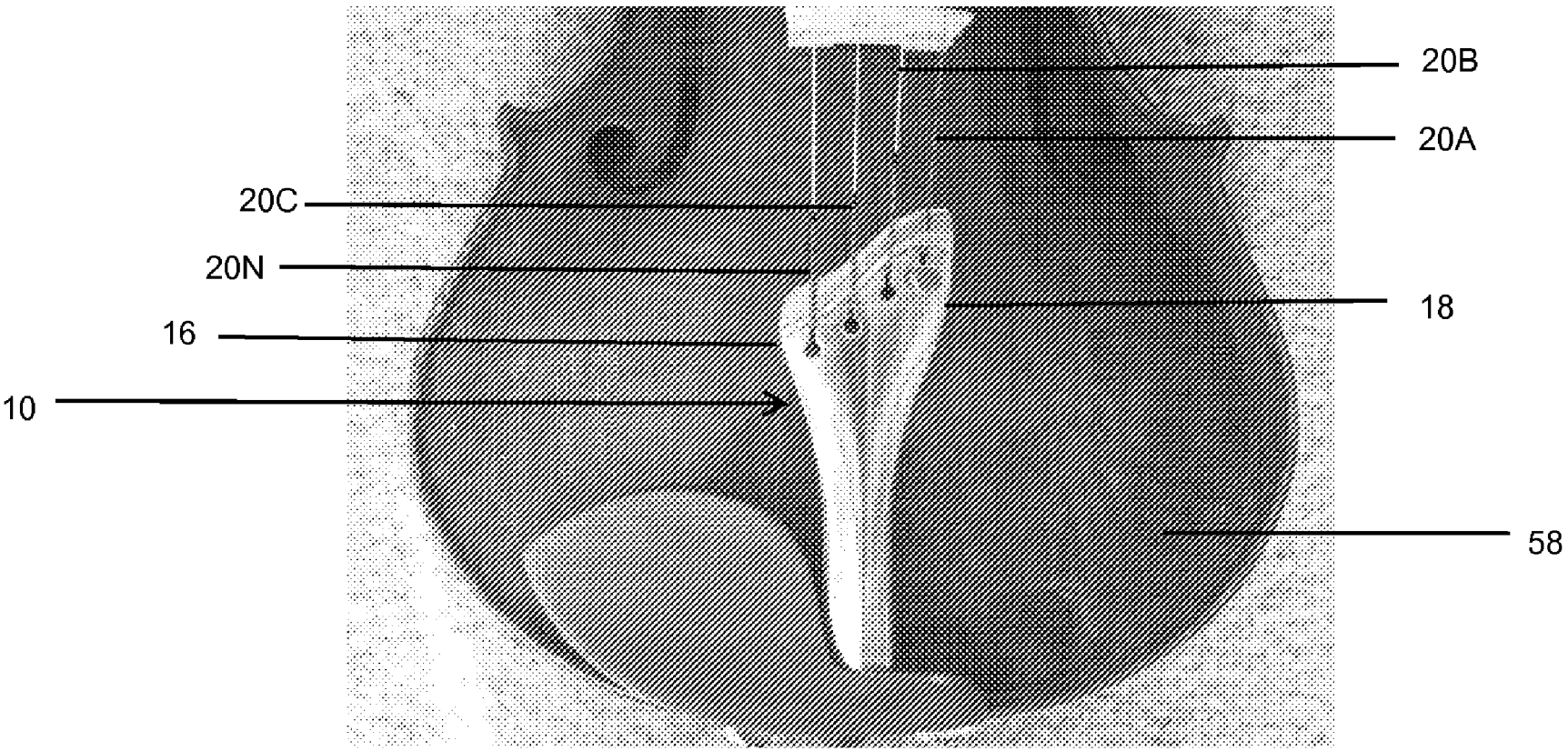
FIG. 3 depicts the tailpiece of the present invention on a musical instrument.

FIG. 3 depicts tailpiece attached to a musical instrument 58. As shown, string holes 20A-N receive strings 60A-N. When bass end 16 is brought under tension (e.g., depressed towards musical instrument 58), tailpiece 10 will twist/rock/teeter as discussed above. One result is that lower set of strings 60C-N will become lengthened, thus, providing difference sounds and/or tones. Tailpiece 20 will have and/or cause a similar reaction.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

What is claimed is:

1. A tailpiece for a musical instrument, comprising:

a treble side;

a bass side opposite the treble side, wherein the treble side is longer than the bass side at a tip of the tailpiece such that the treble side extends further towards a bridge of the musical instrument along an axis oriented from a tail end of the tailpiece towards the tip of the tailpiece; and a topographical surface that causes the tailpiece to twist when the bass side is brought under tension.

2. The tailpiece of claim 1, the topography comprising at least a protrusion that comes in contact with the musical instrument.

3. The tailpiece of claim 1, further comprising a bracket for securing the tailpiece to the musical instrument.

4. The tailpiece of claim 1, further comprising a fine tuning screw positioned proximate treble side.

5. The tailpiece of claim 1, further comprising a plurality of string holes for holding a plurality of strings.

6. The tailpiece of claim 5, the twist lengthening a lower set of the plurality of strings.

7. The tailpiece of claim 1, further comprising a channel extending along a bottom surface of the tail piece.

8. A tailpiece for a musical instrument, comprising:

a treble side;

a bass side opposite the treble side, wherein the treble side is longer than the bass side at a tip of the tailpiece such that the treble side extends further towards a bridge of the musical instrument along an axis oriented from a tail end of the tailpiece towards the tip of the tailpiece; and a 3-dimensional topography along an underside of the tailpiece, the 3-dimensional topography causing the tailpiece to twist when the bass side is brought under tension.

9. The tailpiece of claim 8, the 3-dimensional topography comprising at least a protrusion that comes in contact with the musical instrument.

10. The tailpiece of claim 8, further comprising a bracket for securing the tailpiece to the musical instrument.

11. The tailpiece of claim 8, further comprising a fine tuning screw positioned proximate the treble side.

12. The tailpiece of claim 8, further comprising a plurality of string holes for holding a plurality of strings.

13. The tailpiece of claim 12, the twist lengthening a lower set of the plurality of strings.

14. The tailpiece of claim 8, further comprising a channel extending along the underside of the tail piece.

15. A tailpiece for a musical instrument, comprising:

a treble side;

a bass side opposite the treble side, wherein the treble side is longer than the bass side at a tip of the tailpiece such that the treble side extends further towards a bridge of the musical instrument along an axis oriented from a tail end of the tailpiece towards the tip of the tailpiece;

a 3-dimensional topography along an underside of the tailpiece, the 3-dimensional topography causing the tailpiece to twist when the bass side is brought under tension; and a plurality of string holes for holding a plurality of strings, the twist lengthening a lower set of the plurality of strings.

16. The tailpiece of claim 15, the 3-dimensional topography comprising a protrusion that comes in contact with the musical instrument.

17. The tailpiece of claim 15, further comprising a bracket for securing the tailpiece to the musical instrument.

18. The tailpiece of claim 15, further comprising a fine tuning screw positioned proximate the treble side.

19. The tailpiece of claim 15, further comprising a channel extending along the underside of the tail piece.

* * * * *